US006148893A

United States Patent [19]

Cadorette

[11] Patent Number: 6,148,893

[45] Date of Patent: Nov. 21, 2000

[54] HEAD-RAIL END ADAPTER FOR WINDOW BLINDS

[75] Inventor: Mario Cadorette, Sainte Thérès, Canada

[73] Assignee: All-Teck Blinds P.T.B. Inc., Quebec, Canada

[21] Appl. No.: 09/379,325

[22] Filed: Aug. 23, 1999

[30] Foreign Application Priority Data

Apr. 22, 1999 [CA] Canada ..... 2270006

[51] Int. Cl.[7] ..... E06B 9/36

[52] U.S. Cl. ..... 160/176.1 P; 160/177 V; 160/176.1 V

[58] Field of Search ..... 160/176.1 P, 168.1 P, 160/176.1 R, 176.1 V, 168.1 R, 168.1 V, 177 V, 173 V; 74/625

[56] References Cited

U.S. PATENT DOCUMENTS

| | | | |
|---|---|---|---|
| 3,308,873 | 3/1967 | Dotto | 160/176.1 P |
| 4,096,903 | 6/1978 | Ringle, III | 160/176.1 P |
| 4,122,885 | 10/1978 | Marotto | 160/176.1 R |
| 4,386,644 | 6/1983 | Debs | 160/176.1 V |
| 4,657,060 | 4/1987 | Kaucic | 160/176.1 V |
| 4,773,464 | 9/1988 | Kobayashi | 160/176.1 P |
| 4,836,345 | 6/1989 | Anderson | 160/176.1 V |
| 5,293,921 | 3/1994 | Marocco | 160/176.1 R |

*Primary Examiner*—Blair M. Johnson
*Attorney, Agent, or Firm*—Sughrue, Mion, Zinn, Macpeak & Seas, PLLC

[57] ABSTRACT

A kit is provided for modifying a control mechanism of a cord-operated window blind. The conventional control mechanism comprises a control housing including a removable end plate disposed at an end of a head rail of the blind, and a pulley disposed within the control housing and operatively coupled to a pivot rod of the blind. The kit includes: an adapter unit capable of being operatively mounted on the control housing in place of the removable end plate; and a shaft coupler adapted to be operatively mounted within the adapter unit and capable of operatively coupling an output shaft of the drive unit to the pivot rod. The adapter unit comprises a shaft opening disposed substantially co-axially with the pivot rod, and support means disposed on an exterior surface of the adapter, proximal the opening, for operatively supporting a drive unit of a conventional blind remote control.

22 Claims, 7 Drawing Sheets

HEAD-RAIL END ADAPTER FOR WINDOW BLINDS

CROSS REFERENCE TO RELATED APPLICATIONS

This application is related to, and claims priority of, Canadian Patent Application No. 2,270,006 filed on Apr. 22, 1999.

BACKGROUND OF THE INVENTION

The present invention relates to a kit for modifying a control mechanism of a window blind, and in particular to an easily retrofitable kit for adapting a conventional, cord-operated, window blind for use with a drive motor of a conventional blind remote control unit.

Vertical blinds have become increasingly popular over the past several years. Such blinds typically include a head rail containing tracks extending the length thereof for slidably supporting a plurality of vane carriers, a plurality of vanes suspended from the carriers, a pivot rod extending through the carriers permitting sliding or traversing of the vanes between open and closed positions at one or both ends of the headrail, and a gearing system between the pivot rod and each carrier, whereby rotation of pivot rod causes a corresponding, simultaneous pivoting of the vanes.

The carriers and vanes are usually moved between the open and closed positions using a loop of cord suspended from a control housing at one end of the head rail. The cord is connected to the carrier at the other end of the blind, so that pulling on one side of the cord loop moves the vanes in one direction, and pulling on the other side of the loop moves the vanes in the opposite direction. During opening or closing of the blind, the carriers slide along the stationary pivot rod.

It is common to provide vertical blinds with either manual or powered mechanisms for pivoting the vanes. In the case of a manual system, a pulley within the control housing is coupled to the pivot rod, usually via a gear set within the control housing. In some cases, the pulley is directly coupled to the pivot rod by means of a direct coupler. A control chain is looped onto the pulley and is suspended below the control housing so that the pivot rod can be rotated in either direction by pulling on an appropriate side of the chain. The gear set between the pulley and the pivot rod controls the rotation speed of the pivot rod, relative to the pulley, to ensure that the vanes can be pivoted between fully open and fully closed positions without requiring the user to apply excessive forces to the chain.

Alternatively, a powered mechanism can be used to rotate the pivot rod. In this case, a motorized drive unit, which may be remotely controlled, has an output shaft directly coupled to the pivot rod. Typically, the drive unit will include an internal gear set, which will cause the output shaft to rotate at a speed which will pivot the vanes from fully opened to fully closed positions in a reasonable amount of time, while allowing the motor itself to turn at a suitable speed selected for efficiency, and performance.

An owner of a manually controlled blind may wish to convert the blind to utilize a remotely controlled drive unit. This raises several difficulties. For example, the conventional manual mechanism is designed to rotate the pivot rod via a built-in gear set, and the input speed of that gear set is unlikely to be compatible with the output shaft speed of the conventional motorized drive unit. Thus installing a conventional motorized unit requires either replacement or extensive modification of the manual control system. Either of these alternatives is generally too complex to be satisfactorily performed by the owner of the blind. This problem severely limits the market for remote control systems, because they cannot be sold to owners of pre-existing manual blinds as a "do-it-yourself" retrofit.

SUMMARY OF THE INVENTION

It is an object of the present invention to provide an easy-to-install kit for modifying a conventional blind control mechanism to accommodate a conventional motor-driven remote control unit.

Accordingly, the present invention provides a kit for modifying a control mechanism of a cord-operated window blind, the control mechanism comprising a control housing including a removable end plate disposed at an end of a head rail of the blind, and a pulley disposed within the control housing and operatively coupled to a pivot rod of the blind, the kit comprising: an adapter unit capable of being operatively mounted on the control housing in place of the removable end plate, the adapter unit comprising a shaft opening disposed substantially co-axially with the pivot rod, and support means disposed on an exterior surface of the adapter, proximal the opening, for operatively supporting a drive unit of a conventional blind remote control; and a shaft coupler adapted to be operatively mounted within the adapter unit and capable of operatively coupling an output shaft of the drive unit to the pivot rod.

In an embodiment of the invention the blind control mechanism includes a gear mechanism coupled to the pinion and normally driven by the pulley, the shaft coupler being adapted to replace the pulley and operatively couple the output shaft of the drive unit to an input of the gear mechanism.

In an embodiment of the invention the shaft coupler comprises: a gear assembly operatively mountable within the adapter unit and substantially co-axial with the shaft opening and an input of the gear mechanism, the gear assembly including coupling means for operatively coupling to the drive unit; and an elongate pinion gear capable of operatively coupling the gear assembly to the pivot rod.

In an embodiment of the invention the gear assembly is a planetary gear assembly comprising a mounting plate, a plurality of planet gears rotatably mounted on the mounting plate, and a retainer fixedly mounted of the mounting plate for retaining the planet gears on the mounting plate.

In an embodiment of the invention the coupling means comprises a hub shaft extending from a side of the mounting plate opposite the planet gears.

In an embodiment of the invention the hub shaft comprises at least one elongate groove disposed longitudinally of the hub shaft.

In an embodiment of the invention the hub shaft has a substantially cruciform cross-section.

In an embodiment of the invention the mounting plate further comprises a pinion shaft disposed centrally of the planet gears, the pinion shaft being capable of rotatably supporting an end of the pinion gear.

In an embodiment of the invention the adapter unit further comprises a ring-gear operatively disposed on an interior surface thereof surrounding the opening, the ring gear being operatively engagable with the planet gears of the gear assembly.

In another embodiment of the invention the shaft coupler comprises a direct pinion driver operatively mountable within the adapter unit and substantially co-axial with the shaft opening and an input of the gear mechanism.

In an embodiment of the invention the direct pinion driver comprises a generally circular bearing plate, a hub shaft disposed on one side of the bearing plate and capable of operatively engaging an output shaft of the drive unit, and a drive pinion disposed on the other side of the bearing plate and capable of operatively engaging an input of the gear mechanism.

Preferably, the bearing plate, hub shaft and drive pinion are disposed substantially co-axially with each other.

In an embodiment of the invention the pulley is directly coupled to the pivot rod by via a direct coupler, the shaft coupler being adapted to couple the pulley to an output shaft of the drive unit. In this case the shaft coupler is conveniently provided as a drive clutch operatively mountable within the adapter unit and substantially co-axial with the shaft opening and the pulley.

In an embodiment of the invention the drive clutch comprises a generally circular bearing plate, a hub shaft disposed on one side of the bearing plate and capable of operatively engaging an output shaft of the drive unit, and a clutch stud disposed on the other side of the bearing plate and capable of engaging a corresponding opening in a side of the pulley.

Preferably, the drive clutch includes two or more clutch studs.

In an embodiment of the invention the clutch stud is shaped to generally conform to the corresponding opening of the pulley, an includes a side wall oriented substantially normal to the bearing plate, such that the clutch stud is frictionally received within the opening of the pulley to thereby lock the pulley against rotation with respect to the drive clutch.

In an embodiment of the invention the clutch stud is shaped to permit rotation of the pulley with respect to the drive clutch in an over-torque condition.

In an embodiment of the invention the clutch stud is semi-hemispherical in shape.

A further aspect of the invention provides a method of modifying a control mechanism of a cord-operated window blind, the control mechanism comprising a control housing including a removable end plate disposed at an end of a head rail of the blind, a pulley disposed within the control housing and operatively coupled to a pivot rod of the blind through a gear mechanism, and a control cord operatively engaged with the pulley, the method comprising the steps of: providing a kit comprising an adapter unit capable of being operatively mounted on the control housing in place of the removable end plate, the adapter unit comprising a shaft opening disposed substantially co-axially with the pivot rod, and support means disposed on an exterior surface of the adapter, proximal the opening, for operatively supporting a drive unit of a conventional blind remote control; a gear assembly operatively mountable within the shaft opening and substantially co-axial with the opening and the pivot rod, the gear assembly including a hub shaft for operatively coupling to the drive unit; and an elongate pinion gear capable of operatively coupling the gear assembly to an input of the gear mechanism; removing the end plate from the control housing; removing the pulley and control cord from the pivot rod; operatively coupling the pinion gear to the input of the gar mechanism; operatively coupling the gear assembly to the pinion gear; and affixing the adapter unit to the control housing with the hub shaft of the gear assembly substantially centrally disposed within the shaft opening; and mounting a conventional drive unit of a blind remote control on the exterior of the adapter unit and operatively coupled to the gear assembly, such that the drive unit can cause rotation of the pivot rod, via the gear assembly and the pinion gear.

A still further aspect of the invention provides method of modifying a control mechanism of a cord-operated window blind, the control mechanism comprising a control housing including a removable end plate disposed at an end of a head rail of the blind, a pulley disposed within the control housing and operatively coupled to a pivot rod of the blind via a gear mechanism, and a control cord operatively engaged with the pulley, the method comprising the steps of: providing a kit comprising an adapter unit capable of being operatively mounted on the control housing in place of the removable end plate, the adapter unit comprising a shaft opening disposed substantially co-axially with the input of the gear mechanism, and support means disposed on an exterior surface of the adapter, proximal the opening, for operatively supporting a drive unit of a conventional blind remote control; a direct pinion driver operatively mountable within the opening and substantially co-axial with the opening and the pivot rod, the direct pinion driver including a hub shaft for operatively coupling to the drive unit, and a drive pinion capable of operatively coupling the gear assembly to an input of the gear mechanism; removing the end plate from the control housing; removing the pulley and control cord from the pivot rod; operatively coupling the drive pinion gear to the input of the gear mechanism; affixing the adapter unit to the control housing, within the hub shaft of the direct pinion driver substantially centrally disposed within the shaft opening; and mounting a conventional drive unit of a blind remote control on the exterior of the adapter unit and operatively coupled to the direct pinion driver, such that the drive unit can cause rotation of the pivot rod, via the direct pinion driver.

A still further aspect of the invention provides a method of modifying a control mechanism of a cord-operated window blind, the control mechanism comprising a control housing including a removable end plate disposed at an end of a head rail of the blind, a pulley disposed within the control housing and operatively coupled to a pivot rod of the blind, and a control cord operatively engaged with the pulley, the method comprising the steps of: providing a kit comprising: an adapter unit capable of being operatively mounted on the control housing in place of the removable end plate, the adapter unit comprising a shaft opening disposed substantially co-axially with the pivot rod, and support means disposed on an exterior surface of the adapter, proximal the opening, for operatively supporting a drive unit of a conventional blind remote control; a drive clutch operatively mountable within the opening and substantially co-axial with the shaft opening and the pulley, the drive clutch including a hub shaft for operatively coupling to the drive unit, and a clutch stud capable of operatively engaging a corresponding opening of the pulley; removing the end plate from the control housing; operatively coupling the drive clutch to the pulley; and affixing the adapter unit to the control housing with the hub shaft of the drive clutch substantially centrally disposed within the shaft opening; and mounting a conventional drive unit of a blind remote control on the exterior of the adapter unit and operatively coupled to the drive clutch, such that the drive unit can cause rotation of the pivot rod, via the drive clutch.

BRIEF DESCRIPTION OF THE DRAWINGS

Further features and advantages of the present invention will become apparent from the following detailed description, taken in combination with the appended drawings, in which.

Note that throughout the drawings, like part are identified by like reference numerals.

DESCRIPTION OF THE PREFERRED EMBODIMENTS

Figures 1A, 1B:
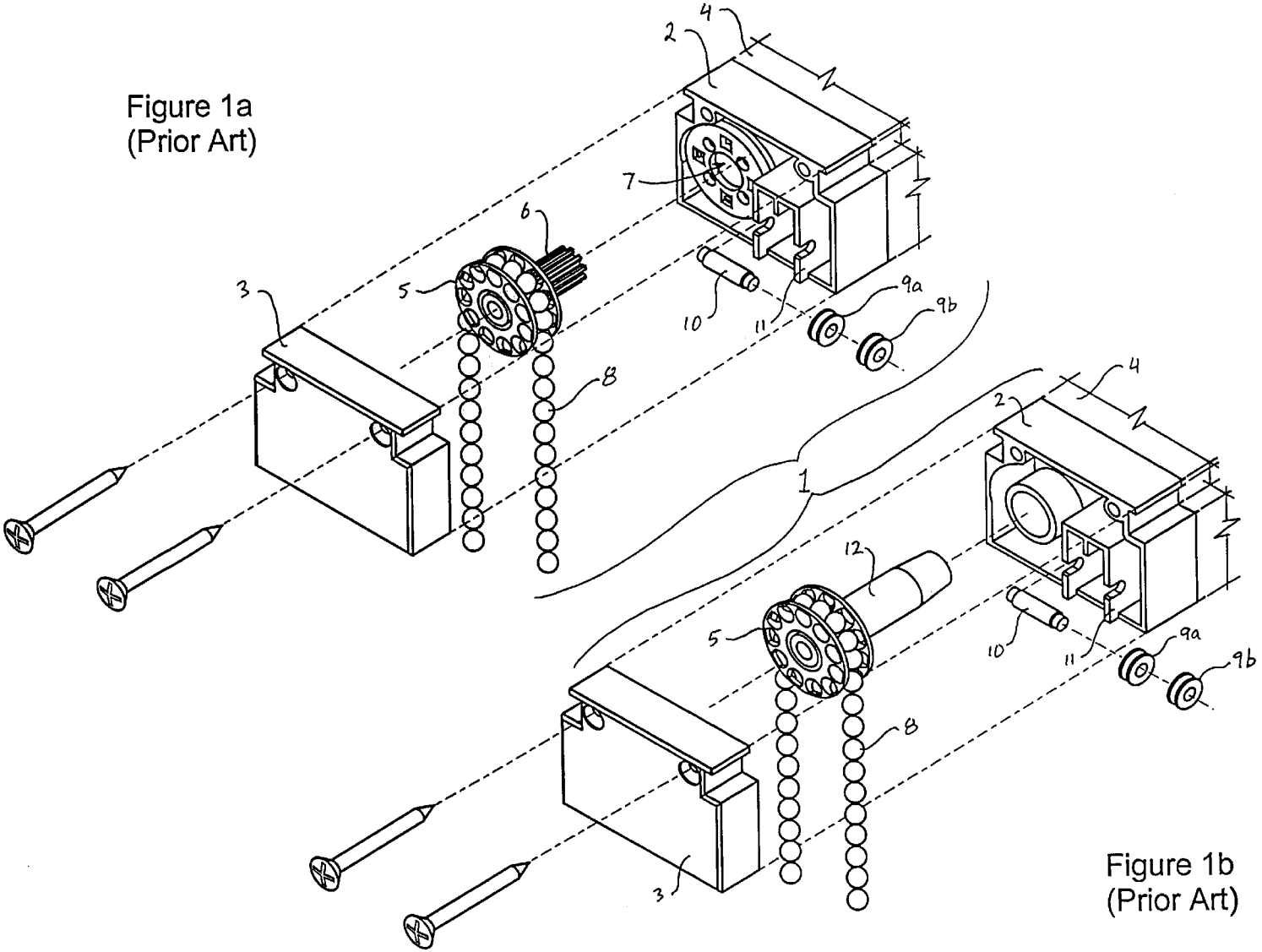
Figure 1a (Prior Art)
Figure 1b (Prior Art)
FIGS. 1*a* and 1*b* show exploded views of respective conventional control mechanisms of a cord-operated window blind.

Referring now to FIG. 1*a*, a conventional control mechanism 1 of a cord-operated window blind comprises a control housing 2 having a removable end plate 3 disposed at an end of the blind head rail 4. A pulley 5 is disposed within the control housing 2 and operatively coupled to a pivot rod (not shown) of the blind, usually via a pinion gear 6 and a gear mechanism generally shown at 7. A control chain (or cord) 8 is suspended over the pulley 5 so that the pivot rod can be selectively rotated in either direction by pulling on a respective side of the control chain 8. The gear mechanism 7 is coupled to the pivot rod, and operates to rotate the pivot rod at a different (usually slower) speed from that of the pulley, thereby allowing a user to rotate the pivot rod without applying excessive tension to the control chain 8. A pair of cord pulleys 9*a* and 9*b* are mounted on a shaft 10 disposed within a pulley guide 11 provided within the control housing 2 to support and guide a second control cord (not shown) which is used to traverse the vanes of the blind.

In some cord-operated window blinds, the pulley 5 is directly coupled to the pivot rod by means of a direct coupler 12 (See FIG. 1*b*). In such cases, the control housing 2*a* does not include a gear mechanism 7, and the pivot rod rotates at a speed equal to that of the pulley 5.

The pulley 5 and pinion gear 6 (or direct coupler 12) may be provided as a single unit (as shown in FIGS. 1*a* and 1*b*), or may be provided as separate components which are assembled together during manufacture of the control mechanism 1.

The present invention provides an easy-to-install kit designed to enable a user to modify the conventional control mechanism so that the pivot rod can be rotated by a drive unit 13 of a conventional blind remote control system. In its broadest conception, the kit comprises an adapter unit 14 which replaces the conventional end plate 3, and a shaft coupler 15 which replaces the conventional pulley 5 and pinion 6 (or which couples to the pulley 5 direct coupler 12).

Figure 2:
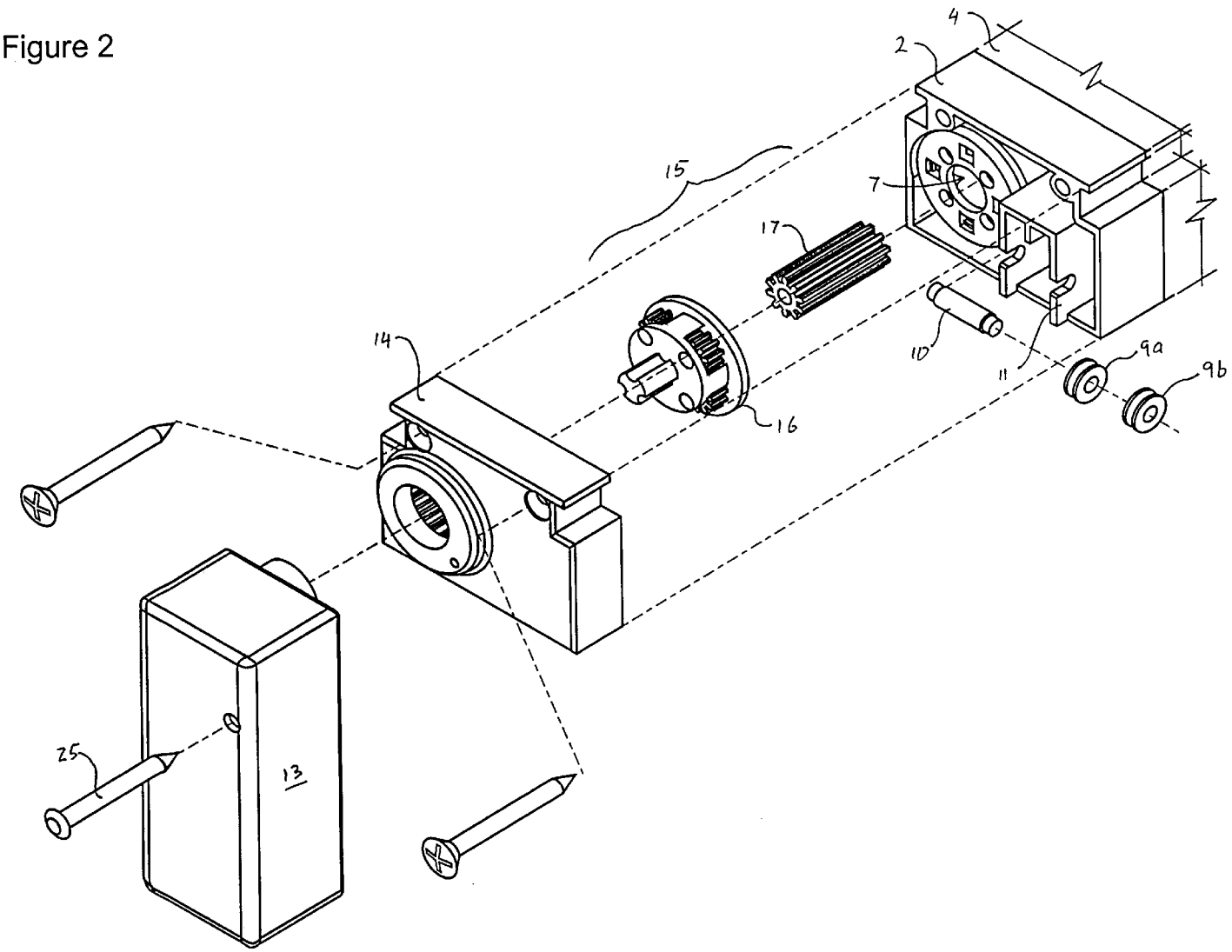
FIG. 2 is an exploded view of a modified control mechanism including a kit in accordance with an embodiment of the present invention.

Referring now to FIG. 2, in a kit according to a first embodiment of the invention, the shaft coupler 15 comprises a gear assembly 16 and a pinion gear 17, respectively replacing the pulley 5 and pinion 6.

Figure 3B:
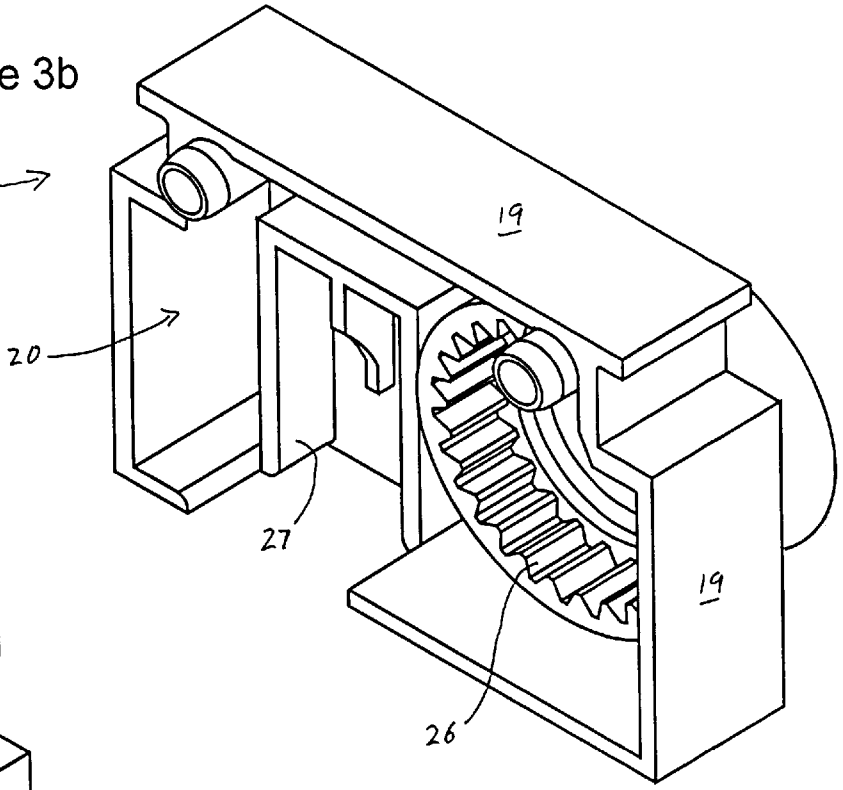
FIGS. 3*a* and 3*b* show respective perspective views of an adapter unit in accordance with the embodiment of FIG. 2.
Figure 3A:
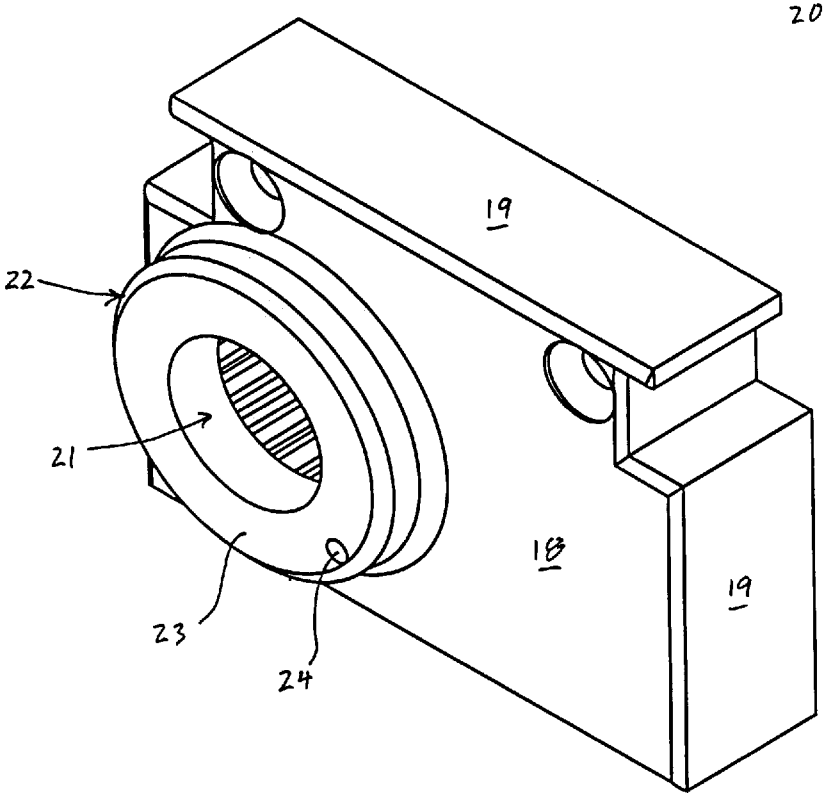

The adapter unit 14 is conveniently composed of an end wall 18, and a perimeter wall 19 extending from and at least partially surrounding the end wall 18 to define an interior space 20 of the adapter unit 14 (see FIGS. 3*a* and 3*b*). The end wall 18 (and thus also the perimeter wall 19) is preferably shaped to conform to the exterior profile of the headrail and control housing 2. Similarly, the adapter unit 14 is preferably formed of the same materials, and provided with substantially the same color as the control housing 2, so that the adapter unit 14 will match the visual appearance of the pre-existing control housing 2.

The end wall 18 of the adapter 14 includes a shaft opening 21 arranged such that, when the adapter unit 14 is mounted on the control housing 2, the shaft opening 21 will be substantially co-axial with the input of the gear set 7 of the control housing 2. On the exterior of the adapter unit 14, a motor support 22 is provided proximal the shaft opening 21 for supporting the drive unit 13 of a conventional blind remote control. In the illustrated embodiment, the motor support 22 comprises a boss 23 surrounding the shaft opening 21, and a screw-hole 24 for receiving a mounting screw 25 of the drive unit 13.

The interior space 20 of the adapter unit 14, includes a ring gear 26 surrounding the shaft opening 21, for operative engagement with the gear assembly 16. Finally, a guide structure 27 is designed to cooperate with the pulley guide 11 of the control housing 2 to guide the pulleys 9*a* and 9*b* and the control cord for traversing the blind.

Figure 4:
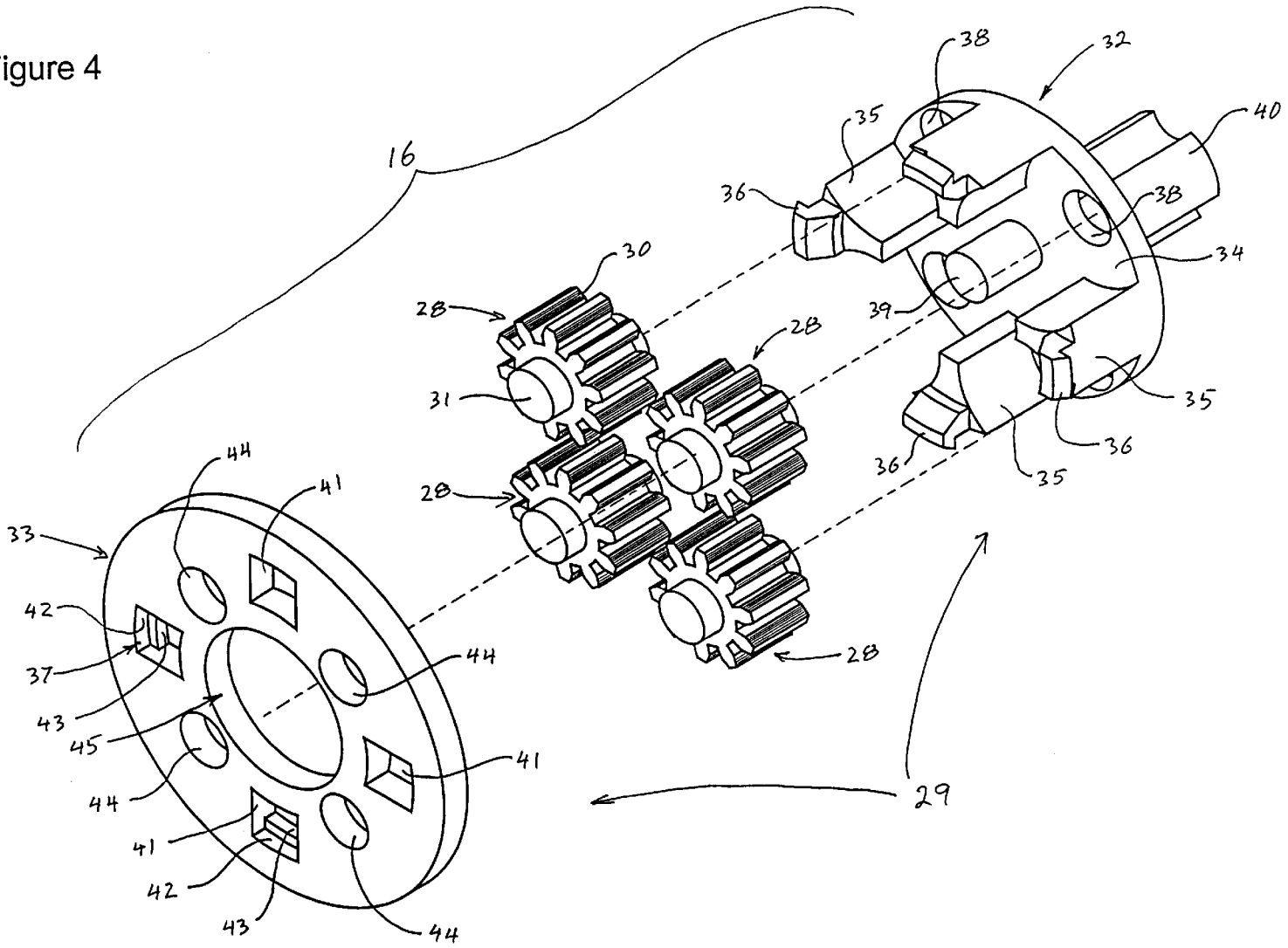
FIG. 4 is an exploded view of a gear assembly in accordance with the embodiment of FIG. 2.

Referring now to FIG. 4, the gear assembly 16 is designed to be mounted within the adapter unit 14 in operative engagement with the ring gear 26, and serves to adjust the rotation speed of the output shaft (not shown) of the conventional drive unit 13, to provide a suitable rotation speed for input to the conventional gear set 7 of the control housing 2. In the illustrated embodiment, the gear assembly 16 is a planetary gear system composed of a plurality of spur gears 28 rotatably mounted within a gear housing 29.

Each spur gear 28 comprises a gear portion 30 and a shaft portion 31 extending from opposite ends of the gear portion 30. The shaft portion 31 and the gear portion 30 can be manufactured as separate components and subsequently assembled, or the spur gear 28 can be manufactured as a single "monolithic" component. In the illustrated embodiment, four spur gears 28 are shown. It will be appreciated that fewer (or more) spur gears 28 may be used. However, preferably there will be three or more spur gears 28, as this provides the advantage that the spur gears 28 can also be used to support the gear assembly 16 within the adapter unit 14 substantially co-axially with the shaft opening 21, thereby eliminating any requirement for additional supporting or bearing surfaces.

The gear housing 29 is generally composed of a main body 32 and a retainer 33. The main body 32 conveniently includes a generally circular hub 34 having one or more support pillars 35 symmetrically disposed about the perimeter thereof. Each support pillar 35, which may be suitably shaped to have a large cross-sectional area (thereby providing good strength and rigidity) while providing adequate clearance for rotation of the spur gears 28, conveniently includes a clip 36 for engaging a cooperating clip portion 37 of the retainer 33 to thereby securely affix the retainer 33 to the main body 32. Alternatively, other means of securing the retainer 33 to the main body 32 could be used, such as adhesives, thermal welding, or the like. A number (corresponding to the number of spur gears 28) of bearing holes 38 are symmetrically disposed about the hub 34, for operatively receiving a shaft portion 31 of a respective spur gear 28. A generally cylindrical pinion shaft 39 is disposed centrally of the hub 34, and on the same side thereof as the support pillars 35. Finally, a hub shaft 40 is disposed centrally of the hub 34, opposite the pinion shaft 39. The hub shaft 40 is designed to operatively couple the gear housing 29 to the output shaft of the drive unit 13, so that operation of the drive unit 13 will cause rotation of the gear housing 29 within the adapter unit 14. For this purpose, the hub shaft 40 can conveniently be provided with a grooved or cruciform cross-sectional shape, which is similar to the cross-section of the pivot rod with which the drive unit 13 is conventionally designed to engage. By this means, the gear assembly 16 can be operatively coupled to the drive unit 13 without the need for additional adapter couplings, or modifications to the drive unit 13.

The retainer 33 is conveniently provided as an annular disc having a clip portion 37 corresponding to each clip 36 of the main body 32 to facilitate securing the retainer 33 to the main body 32. In the illustrated embodiment, each clip portion 37 comprises a generally rectangular passage 41 through the retainer 33. An outer wall 42 of the passage 41 includes a detent 43 for engaging a corresponding clip 36 of the main body 32. In addition to the clip portions 37, the retainer includes a bearing hole 44 corresponding to each bearing hole 38 of the hub 34, for receiving a shaft portion 31 of a corresponding spur gear 28. Finally, the retainer 33, includes a centrally located opening 45 sized to permit passage therethrough of the pinion 17.

Figure 5:
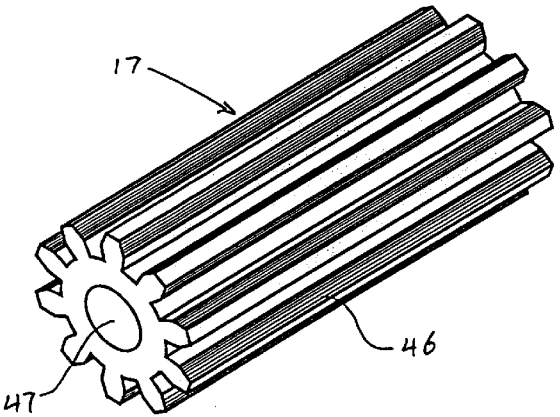
FIG. 5, is an enlarged perspective view of a pinion gear usable in the embodiment of FIG. 2.

Referring now to FIG. 5, the pinion gear 17 is generally formed as an elongated gear element 46 having sufficient length to extend from the hub 34 of the gear assembly housing 29 to the input of the gear set 7 of the manual control mechanism. Conveniently, one end (or both ends if desired) of the pinion gear 17 can be provided with a bearing hole 47 designed to slide over the pinion shaft 39 of the gear housing 29. Thus the pinion gear 17 can be inserted into the gear assembly 16, through the opening 45 of the retainer 33 and into operative engagement with the spur gears 28, and will be retained in alignment with the input of the control mechanism gear set 7, by the pinion shaft 39 of the gear assembly hub 34.

In use, a kit in accordance with a first embodiment of the invention is employed to modify a conventional cord-operated blind as follows:

The end plate 3 of the blind control housing 2 is removed;

The pivot rod control chain (cord) 8 and its pulley 5, and accompanying pinion 6 are removed;

One end of the pinion gear 17 is inserted into the gear assembly 16, onto the pinion shaft 39 of the hub 34, and in operative engagement with the spur gears 28;

The gear assembly 16 is inserted into the adapter unit 14 with the hub shaft 40 protruding through the shaft opening 21, and the spur gears 28 engaging the ring gear 26;

The adapter unit 14, along with the gear assembly 16 and pinion gear 17, is then fitted onto the control housing 2, and the free end of the pinion gear 17 engaged with the input of the control housing gear set 7;

Finally, the drive unit 13 is mounted on the motor support 22 on the exterior of the adapter unit 14 with the output shaft of the drive unit 13 in operative engagement with the hub shaft 40 of the gear assembly 16.

Figure 7:
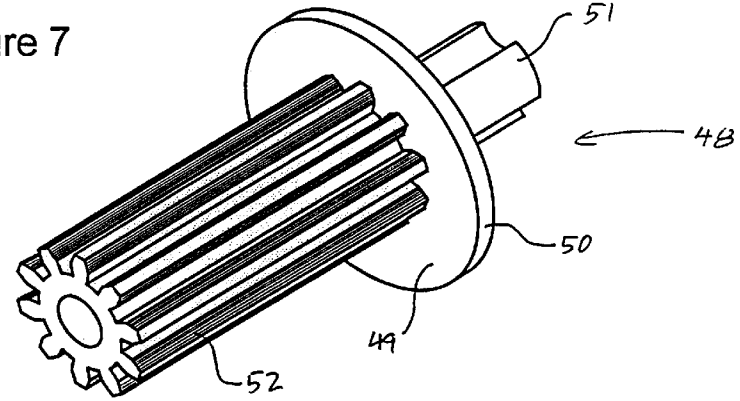
FIG. 7 is an enlarged perspective view of a direct coupler usable in the embodiment of FIG. 6.
Figure 6:
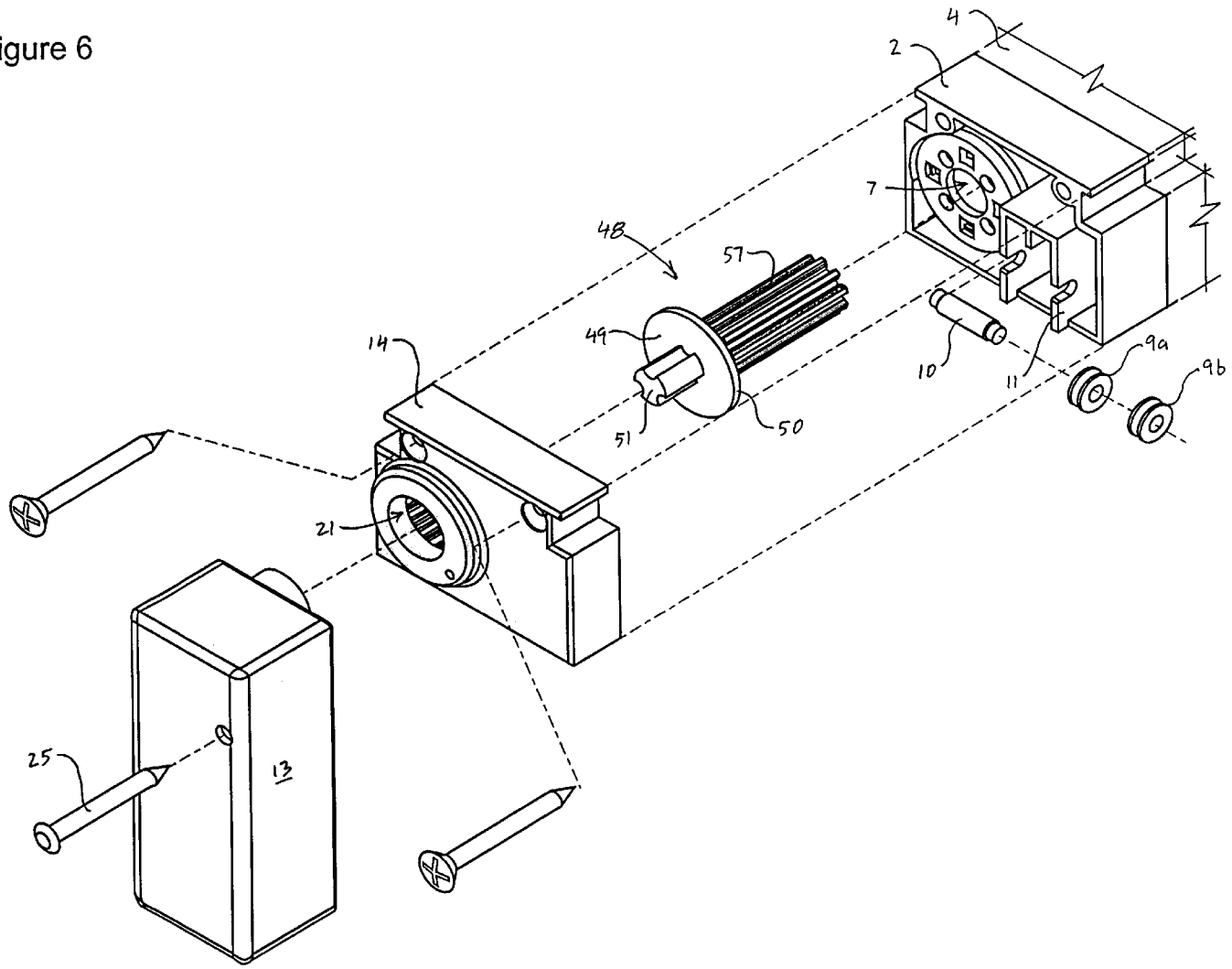
FIG. 6 is an exploded view of a modified control mechanism including a kit in accordance with a second embodiment of the present invention.

FIGS. 6 and 7 illustrate a kit in accordance with a second embodiment of the present invention, which is particularly suitable where the headrail is unusually long (e.g. greater than 275 cm). In this second embodiment of the invention, the shaft coupler 15 is provided by a direct pinion driver 48. In contrast to the first embodiment of the invention discussed above in connection with FIGS. 1–5, the direct pinion driver 48 directly couples the output shaft of the drive unit 13 to the input of the gear mechanism 7, without effecting any alteration of the speed of rotation. In practice, this means that the gear mechanism 7 will be driven at a slower speed than would be the case in the first embodiment of the invention, with the result that the vanes of the blind will pivot more slowly. However, because of the slower rotation speed, the gear mechanism 7 will be driven with a higher torque, and thus will be able to overcome the greater friction loads which are typically encountered in long blinds having a large number of vanes.

The direct pinion driver 48 includes a generally circular bearing plate 49 having a peripheral edge 50, a hub shaft 51 disposed substantially concentrically on one side of the bearing plate 49, and a drive pinion 52 disposed substantially concentrically on the other side of the bearing plate 49. The diameter of the bearing plate 49 is selected to be slightly smaller than the interior diameter of the ring gear 26, so that the bearing plate 49 can be rotatably inserted into the ring gear 26 and retained in a substantially concentric position by sliding engagement between the peripheral edge 50 and the tips of teeth forming the ring gear 26.

The hub shaft 51 is designed to operatively couple the direct pinion driver 48 to the output shaft of the drive unit 13, so that operation of the drive unit 13 will cause rotation of the direct pinion driver 48 within the adapter unit 14. For this purpose, the hub shaft 51 can conveniently be provided with a grooved or cruciform cross-sectional shape, which is similar to the cross-section of the pivot rod with which the drive unit 13 is conventionally designed to engage. By this means, the direct pinion driver can be operatively coupled to the drive unit 13 without the need for additional adapter couplings, or modifications to the drive unit 13.

The drive pinion 52 is similar to the pinion gear 17, and serves to couple the direct pinion driver 48 to the gear mechanism 7 of the control housing.

In use, a kit in accordance with the second embodiment of the invention is employed to modify a conventional cord-operated blind as follows:

The end plate 3 of the blind control housing 2 is removed;

The pivot rod control chain (cord) 8 and its pulley 5, and accompanying pinion 6 are removed;

The direct pinion driver 48 is then fitted onto the control housing 2, and the free end of the drive pinion 52 engaged with the input of the control housing gear set 7;

The adapter unit 14 is mounted on the control housing 2 with the bearing plate 49 slidably disposed in the ring gear 26 and the hub shaft 51 concentrically disposed in the shaft opening 21;

Finally, the drive unit 13 is mounted on the motor support 22 on the exterior of the adapter unit 14 with the output shaft of the drive unit 13 in operative engagement with the hub shaft 51 of the direct pinion driver 48.

Figure 9:
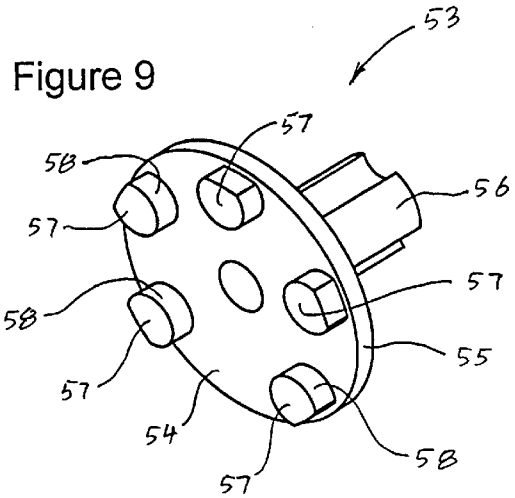
FIG. 9 is an enlarged perspective views of a drive clutch usable in the embodiment of FIG. 8.
Figure 8:
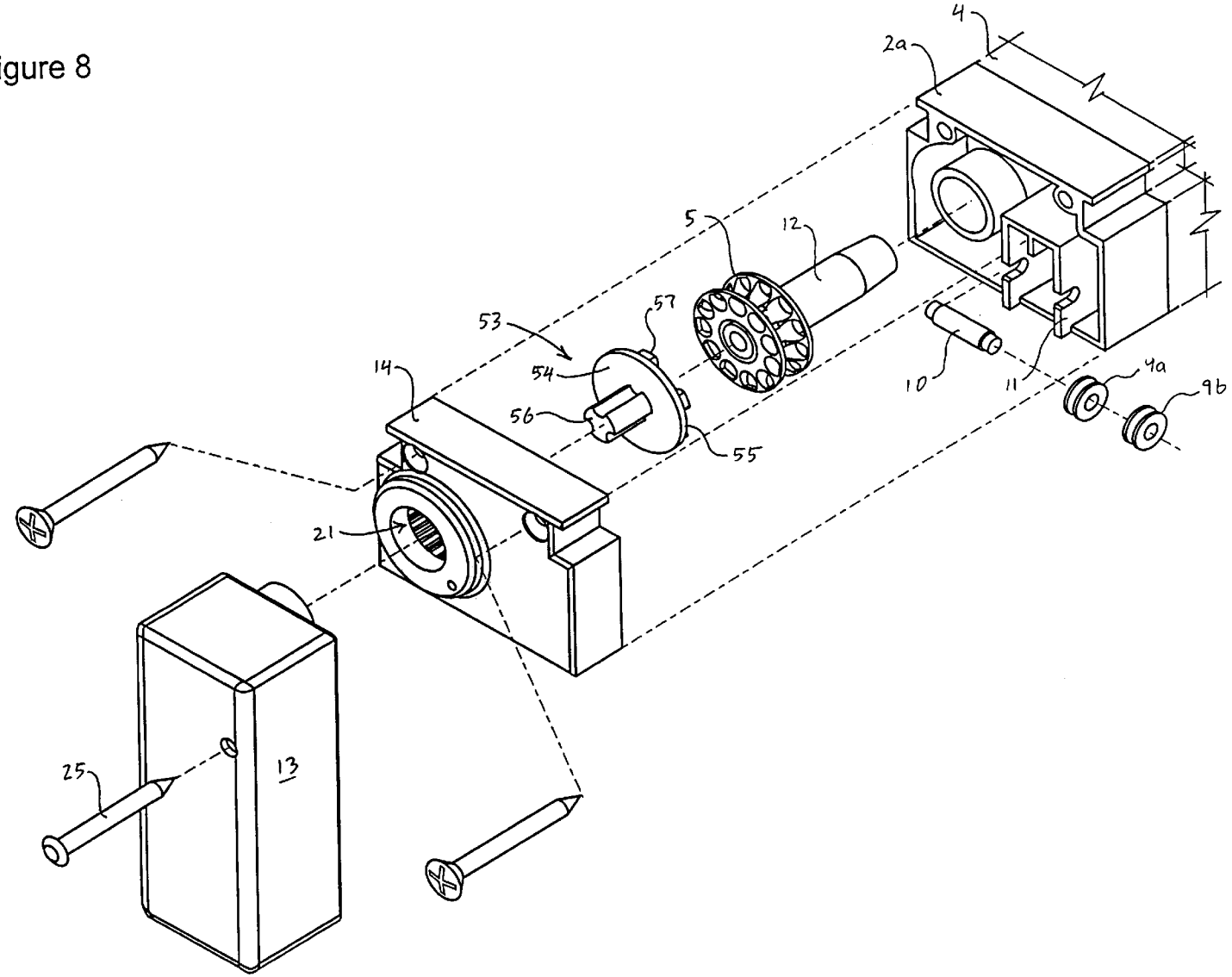
FIG. 8 is an exploded view of a modified control mechanism including a kit in accordance with a third embodiment of the present invention.

FIGS. 8–9 illustrate a kit in accordance with a third embodiment of the present invention, which is particularly suitable for use in conjunction with a control housing in which the pulley 5 is directly coupled to the pivot rod by means of a direct coupler 12 (FIG. 1), and the control housing 2*a* does not include a gear mechanism 7. In this third embodiment of the invention, the shaft coupler 15 is provided by a drive clutch 53.

Referring to FIG. 9, the drive clutch 53 includes a generally circular bearing plate 54 having a peripheral edge 55, a hub shaft 56 disposed substantially concentrically on one side of the bearing plate, and one or more clutch studs 56 disposed on the other side of the bearing plate 54. The diameter of the bearing plate 54 is selected to be slightly smaller than the interior diameter of the ring gear 26, so that the bearing plate 54 can be rotatably inserted into the ring gear 26 and retained in a substantially concentric position with respect to the shaft opening 21 by sliding engagement between the peripheral edge 55 and tips of the teeth forming the ring gear 26.

The hub shaft 56 is designed to operatively couple the drive clutch 53 to the output shaft of the drive unit 13, so that operation of the drive unit 13 will cause rotation of the drive clutch 53 within the adapter unit 14. For this purpose, the hub shaft 56 can conveniently be provided with a grooved or cruciform cross-sectional shape, which is similar to the cross-section of the pivot rod with which the drive unit 13 is conventionally designed to engage. By this means, the drive clutch 53 can be operatively coupled to the drive unit 13 without the need for additional adapter couplings, or modifications to the drive unit 13.

Each clutch stud 57 is designed to engage a corresponding opening on a side of the pulley 5, and thereby lock the drive clutch 53 against rotation with respect to the pulley 5. By this means, torque from the drive unit 13 can be transmitted to the pulley 5 (via the hub shaft 56, bearing plate 54 and clutch studs 57), and thereby cause rotation of the pivot rod.

In the illustrated embodiment, five clutch studs 57 are employed. However, it will be understood that fewer (or more) clutch studs 57 may be utilized as desired. Preferably, there will be two or more clutch studs 57. Still more preferably, the clutch studs will be distributed as widely as possible about the bearing plate 54 (commensurate with the design of the pulley 5), so that the drive clutch 53 will not tend to drift out of alignment with the pulley 5 and the output shaft of the drive unit 13 while in use.

Referring again to FIG. 9*b*, it will be seen that the clutch studs 57 are shaped to conform to the shape of openings on the sides of the pulley 5, and include side walls 58 which are generally normal to the surface of the bearing plate 54. This shape has the advantage that each of the side walls 59 of the clutch studs 57 can frictionally engage interior surfaces of corresponding openings of the pulley 5, which securely affixes the drive clutch 53 to the pulley 5, and maximizes the transmission of torque loads between the drive clutch 53 and the pulley 5. However, it will be recognized that the clutch studs 57 may be provided with a different (for example, a semi-hemispherical) shape if desired. The use of a semi-hemispherical shape for the clutch studs 57 means that in an over-torque condition (for example if one of the vanes of the blind becomes jammed and cannot rotate), then the drive clutch 53 can slip with respect to the pulley 5, and so prevent damage to any components of the blind.

In use, a kit in accordance with the third embodiment of the invention is employed to modify a conventional cord-operated blind as follows:

The end plate 3 of the blind control housing 2 is removed;

The pivot rod control chain (cord) 8 is removed;

The drive clutch 53 is then fitted onto the side of the pulley 5 with the clutch studs 57 in operative engagement with corresponding openings of the pulley 5;

The adapter unit 14 is mounted on the control housing with the bearing plate 54 slidably disposed in the ring gear 26 and the hub shaft 56 concentrically disposed within the shaft opening 21;

Finally, the drive unit 13 is mounted on the motor support 22 on the exterior of the adapter unit 14 with the output shaft of the drive unit 13 in operative engagement with the hub shaft of the drive clutch.

It will be apparent that various modifications may be made in the above-described embodiments, without departing from the scope of the present invention. It will also be apparent that the gear assembly 16 and pinion 17, direct pinion driver 48, and drive clutch 53 could be packaged with an adapter 14 as three individual kits, in which case, a customer can purchase a kit containing only those components which are needed to convert their particular blind. Alternatively, adapter 14, gear assembly 16, pinion gear 17, direct pinion driver 48, and drive clutch 53 could all be packaged together as a "universal" kit. In this case, the user would be able to select, and use, only those components needed to convert their specific blind. Thus it will be seen that the above-described embodiments are intended to be illustrative, rather than limitative of the present invention.

What is claimed is:

1. A kit for modifying a control mechanism of a cord-operated window blind, the control mechanism comprising a control housing including a removable end plate disposed at an end of a head rail of the blind, and a pulley disposed within the control housing and operatively coupled to a pivot rod of the blind, the kit comprising:

(a) an adapter unit, separate and distinct from the control mechanism, capable of being operatively mounted on the control housing in place of the removable end plate, the adapter unit comprising a shaft opening disposed substantially co-axially with the pivot rod, and support means disposed on an exterior surface of the adapter unit, proximal the opening, for operatively supporting a drive unit of a conventional blind remote control; and (b) a shaft coupler adapted to be operatively mounted within the adapter unit and capable of operatively coupling an output shaft of the drive unit to the pivot rod.

2. A kit as defined in claim 1, wherein the blind control mechanism includes a gear mechanism coupled to the pinion and normally driven by the pulley, the shaft coupler being adapted to replace the pulley and operatively couple the output shaft of the drive unit to an input of the gear mechanism.

3. A kit as claimed in claim 2, wherein the shaft coupler comprises:

(a) a gear assembly operatively mountable within the adapter unit and substantially co-axial with the shaft opening and an input of the gear mechanism, the gear assembly including coupling means for operatively coupling to the drive unit; and (b) an elongate pinion gear capable of operatively coupling the gear assembly to the pivot rod.

4. A kit as defined in claim 3, wherein the gear assembly is a planetary gear assembly comprising a mounting plate, a plurality of planet gears rotatably mounted on the mounting plate, and a retainer fixedly mounted of the mounting plate for retaining the planet gears on the mounting plate.

5. A kit as defined in claim 4, wherein the coupling means comprises a hub shaft extending from a side of the mounting plate opposite the planet gears.

6. A kit as defined in claim 5, wherein the hub shaft comprises at least one elongate groove disposed longitudinally of the hub shaft.

7. A kit as defined in claim 5, wherein the hub shaft has a substantially cruciform cross-section.

8. A kit as defined in claim 4, wherein the mounting plate further comprises a pinion shaft disposed centrally of the planet gears, the pinion shaft being capable of rotatably supporting an end of the pinion gear.

9. A kit as defined in claim 4, wherein the adapter unit further comprises a ring-gear operatively disposed on an interior surface thereof surrounding the opening, the ring gear being operatively engagable with the planet gears of the gear assembly.

10. A kit as claimed in claim 2, wherein the shaft coupler comprises a direct pinion driver operatively mountable within the adapter unit and substantially co-axial with the shaft opening and an input of the gear mechanism.

11. A kit as claimed in claim 10, wherein the direct pinion driver comprises a generally circular bearing plate, a hub shaft disposed on one side of the bearing plate and capable of operatively engaging an output shaft of the drive unit, and a drive pinion disposed on the other side of the bearing plate and capable of operatively engaging an input of the gear mechanism.

12. A kit as claimed in claim 11, wherein the bearing plate, hub shaft and drive pinion are disposed substantially co-axially with each other.

13. A kit as claimed in claim 1, wherein the pulley is directly coupled to the pivot rod by via a direct coupler, the shaft coupler being adapted to couple the pulley to an output shaft of the drive unit.

14. A kit as claimed in claim 13, wherein the shaft coupler is provided as a drive clutch operatively mountable within the adapter unit and substantially co-axial with the shaft opening and the pulley.

15. A kit as claimed in claim 14, wherein the drive clutch comprises a generally circular bearing plate, a hub shaft disposed on one side of the bearing plate and capable of operatively engaging an output shaft of the drive unit, and a clutch stud disposed on the other side of the bearing plate and capable of engaging a corresponding opening in a side of the pulley.

16. A kit as claimed in claim 15, wherein the drive clutch includes two or more clutch studs.

17. A kit as claimed in claim 15, wherein the clutch stud is shaped to generally conform to the corresponding opening of the pulley, an includes a side wall oriented substantially normal to the bearing plate, such that the clutch stud is frictionally received within the opening of the pulley to thereby lock the pulley against rotation with respect to the drive clutch.

18. A kit as claimed in claim 15, wherein the clutch stud is shaped to permit rotation of the pulley with respect to the drive clutch in an over-torque condition.

19. A kit as claimed in claim 18, wherein the clutch stud is semi-hemispherical in shape.

20. A method of modifying a control mechanism of a cord-operated window blind, the control mechanism comprising a control housing including a removable end plate disposed at an end of a head rail of the blind, a pulley disposed within the control housing and operatively coupled to a pivot rod of the blind through a gear mechanism, and a control cord operatively engaged with the pulley, the method comprising the steps of:

(a) providing a kit comprising:

an adapter unit capable of being operatively mounted on the control housing in place of the removable end plate, the adapter unit comprising a shaft opening disposed substantially co-axially with the pivot rod, and support means disposed on an exterior surface of the adapter, proximal the opening, for operatively supporting a drive unit of a conventional blind remote control;

a gear assembly operatively mountable within the shaft opening and substantially co-axial with the opening and the pivot rod, the gear assembly including a hub shaft for operatively coupling to the drive unit; and an elongate pinion gear capable of operatively coupling the gear assembly to an input of the gear mechanism;

(b) removing the end plate from the control housing;

(c) removing the pulley and control cord from the pivot rod;

(d) operatively coupling the pinion gear to the input of the gear mechanism;

(e) operatively coupling the gear assembly to the pinion gear; and (f) affixing the adapter unit to the control housing with the hub shaft of the gear assembly substantially centrally disposed within the shaft opening; and (g) mounting a conventional drive unit of a blind remote control on the exterior of the adapter unit and operatively coupled to the gear assembly, such that the drive unit can cause rotation of the pivot rod, via the gear assembly and the pinion gear.

21. A method of modifying a control mechanism of a cord-operated window blind, the control mechanism comprising a control housing including a removable end plate disposed at an end of a head rail of the blind, a pulley disposed within the control housing and operatively coupled to a pivot rod of the blind via a gear mechanism, and a control cord operatively engaged with the pulley, the method comprising the steps of:

(a) providing a kit comprising:

an adapter unit capable of being operatively mounted on the control housing in place of the removable end plate, the adapter unit comprising a shaft opening disposed substantially co-axially with the input of the gear mechanism, and support means disposed on an exterior surface of the adapter, proximal the opening, for operatively supporting a drive unit of a conventional blind remote control;

a direct pinion driver operatively mountable within the opening and substantially co-axial with the opening and the pivot rod, the direct pinion driver including a hub shaft for operatively coupling to the drive unit, and a drive pinion capable of operatively coupling the gear assembly to an input of the gear mechanism;

(b) removing the end plate from the control housing;

(c) removing the pulley and control cord from the pivot rod;

(d) operatively coupling the drive pinion gear to the input of the gear mechanism;

(e) affixing the adapter unit to the control housing, within the hub shaft of the direct pinion driver substantially centrally disposed within the shaft opening; and (f) mounting a conventional drive unit of a blind remote control on the exterior of the adapter unit and operatively coupled to the direct pinion driver, such that the drive unit can cause rotation of the pivot rod, via the direct pinion driver.

22. A method of modifying a control mechanism of a cord-operated window blind, the control mechanism comprising a control housing including a removable end plate disposed at an end of a head rail of the blind, a pulley disposed within the control housing and operatively coupled to a pivot rod of the blind, and a control cord operatively engaged with the pulley, the method comprising the steps of:

(a) providing a kit comprising:

an adapter unit capable of being operatively mounted on the control housing in place of the removable end plate, the adapter unit comprising a shaft opening disposed substantially co-axially with the pivot rod, and support means disposed on an exterior surface of the adapter, proximal the opening, for operatively supporting a drive unit of a conventional blind remote control;

a drive clutch operatively mountable within the opening and substantially co-axial with the shaft opening and the pulley, the drive clutch including a hub shaft for operatively coupling to the drive unit, and a clutch stud capable of operatively engaging a corresponding opening of the pulley;

(b) removing the end plate from the control housing;

(c) operatively coupling the drive clutch to the pulley; and (d) affixing the adapter unit to the control housing with the hub shaft of the drive clutch substantially centrally disposed within the shaft opening; and (e) mounting a conventional drive unit of a blind remote control on the exterior of the adapter unit and operatively coupled to the drive clutch, such that the drive unit can cause rotation of the pivot rod, via the drive clutch.

* * * * *